US009067182B2

(12) United States Patent
Nichols et al.

(10) Patent No.: US 9,067,182 B2
(45) Date of Patent: Jun. 30, 2015

(54) POLYMER DISSOLUTION EQUIPMENT SUITABLE FOR LARGE FRACTURING OPERATIONS

(75) Inventors: Peter Nichols, Savannah, GA (US); Marshall Bond, Richmond Hill, GA (US)

(73) Assignee: S.P.C.M. SA (FR)

( * ) Notice: Subject to any disclaimer, the term of this patent is extended or adjusted under 35 U.S.C. 154(b) by 659 days.

(21) Appl. No.: 13/477,826

(22) Filed: May 22, 2012

(65) Prior Publication Data

US 2013/0292122 A1 Nov. 7, 2013

(30) Foreign Application Priority Data

May 4, 2012 (FR) ..... 12 54119

(51) Int. Cl.

| | |
|---|---|
| ***B02C 23/18*** | (2006.01) |
| ***B01F 7/00*** | (2006.01) |
| ***E21B 43/26*** | (2006.01) |
| ***E21B 21/06*** | (2006.01) |
| ***B01F 13/00*** | (2006.01) |
| ***B01F 15/02*** | (2006.01) |
| ***B01F 3/12*** | (2006.01) |

(52) U.S. Cl.

CPC ..... *B01F 7/00758* (2013.01); *B02C 23/18* (2013.01); *E21B 43/26* (2013.01); *E21B 21/062* (2013.01); *B01F 13/004* (2013.01); *B01F 15/0235* (2013.01); *B01F 3/1221* (2013.01)

(58) Field of Classification Search

CPC ..... C08J 3/03; B02C 23/18; B02C 23/36; E21B 43/26; E21B 21/062; B01F 7/00758; B01F 13/004; B01F 3/1221; B01F 15/0235

USPC ..... 241/62, 101.2, 38

See application file for complete search history.

(56) References Cited

U.S. PATENT DOCUMENTS

| | | | |
|---|---|---|---|
| 2004/0136262 | A1 | 7/2004 | Wilson |
| 2004/0218463 | A1 | 11/2004 | Allen |
| 2004/0256106 | A1 | 12/2004 | Phillippi et al. |
| 2006/0176771 | A1 | 8/2006 | Adams |

FOREIGN PATENT DOCUMENTS

| | | | |
|---|---|---|---|
| EP | 0238723 | A2 | 9/1987 |
| EP | 0665050 | A1 | 8/1995 |
| EP | 1743913 | A1 | 1/2007 |
| WO | 2004007894 | A2 | 1/2004 |
| WO | 2008107492 | A1 | 9/2008 |
| WO | 2010020698 | A2 | 2/2010 |

*Primary Examiner* — Mark Rosenbaum

(74) *Attorney, Agent, or Firm* — St. Onge Steward Johnston & Reens LLC

(57) ABSTRACT

Compact and transportable equipment that can be used for fracturing operations on gas or oil fields, includes, successively, a silo for storing polymer in powder form, a feed hopper of a polymer metering device, a device for metering out the powder polymer, a device for dispersing and grinding the polymer, and at least two volumetric pumps enabling the injection and metering of the polymer solution obtained in the mixer used for supplying at least one high-pressure fracturing pump.

12 Claims, 2 Drawing Sheets

POLYMER DISSOLUTION EQUIPMENT SUITABLE FOR LARGE FRACTURING OPERATIONS

CROSS-REFERENCE TO RELATED APPLICATIONS

The present Application claims priority of French Patent Application No. 1254119 filed on May 4, 2012, the content of which is incorporated herein by reference.

FIELD OF THE INVENTION

The field of the invention is the recovery of gas or oil and more particularly the hydraulic fracturing of gas or oil wells by injection of a fracturing fluid comprising a polymer.

BACKGROUND OF THE INVENTION

Document WO 2010/020698 describes equipment used for storing, dispersing and dissolving polymers in powder form, more particularly based on acrylamide. The polymer solution is then metered out and used in hydraulic fracturing operations intended for the production of shale gas or dispersed petroleum.

This equipment has significant operating constraints since fracturing operations assemble numerous vehicles (lorries, trailers), sometimes more than 100, comprising electrical generators, transportation of pumps, mixers, devices for dissolving and adding adjuvants, control rooms and above all large amounts of sands or ceramic beads that are used to keep the fractures open.

The cost of such operations is very high and one of the success factors is the total time for fracturing and for the transfer of the equipment, which ensures the profitability of the fracturing run. It is therefore essential that the equipment used gives the best performances without risk of interruption. If not, the well to be fractured may clog up, which can be catastrophic.

All the equipment must therefore be able to be moved on wheels, either by lorries or on trailers, while taking into consideration the road weight restrictions which depend on the geographical zone in question. Usually, the weight excluding the chassis should not exceed 20 to 24 tonnes and the length 12 to 14 meters. It is furthermore necessary that it be immediately available after its journey without wasting time in the initial filling operations.

The acrylamide-based polymers injected are polymers, preferably of high molecular weight, greater than 10 million, usually greater than 15 million. Their composition depends on the salinity of the water and above all on the amount of divalent metals ($Ca^{++}$, $Mg^{++}$).

- For fresh water, acrylamide/acrylic acid copolymers (60/40 mol % to 90/10 mol %) are usually used.
- For more saline waters, weakly anionic or nonionic copolymers containing from 0 to 10 mol % of acrylic acid or having a low content of sulphonated monomer (ATBS acrylamido tert-butyl sulphonate) are used;
- For very saline waters, use may be made of acrylamide/trimethylaminoethyl acrylate chloride copolymers (90/10 mol %) for example.
- In extreme cases, use may be made of polymers of DADMAC (diallyldimethyl-ammonium chloride), NVP (N-vinylpyrrolidone), etc.

Although the equipment described in document WO 2010/020698 performs well, it is however limited in terms of the amount of polymer treated, and has the following constraints:

- The polymer is supplied as 25 kg bags, at best as 750 kg big bags, at a speed that is incompatible with large-scale recovery operations.
- Impossibility of being supplied in bulk during operation.
- Difficulty of metering out and dispersing the polymer at high concentration so as to limit the volumes of polymer dispersion and/or solution in the equipment.
- Difficulty in avoiding the formation of aggregates (known as fish eyes), which can only dissolve over a very long time and which, furthermore, may block the pumps.
- Difficulty in dissolving the suspension within a short period, since the volumes available on a lorry are limited.
- Difficulty in pumping the polymer solution in a controlled manner in the mixer, which comes before the very-high-pressure injection pump and which homogenizes all the ingredients.

Some people use metal containers that are difficult to handle on ground that is often muddy.

The current development, with the increase in the length of horizontal bore holes, is to tend towards larger fracturing operations. A few months ago, the operations required from 4 to 8 tonnes of polymer per operation and the equipment described in document WO 2010/020698 is suitable for this type of operation.

Nowadays, the amounts injected range from 9 to 15 tonnes and probably in the future about 20 tonnes per operation, and the equipment described in document WO 2010/020698 is no longer suitable.

SUMMARY OF THE INVENTION

It is thus necessary to develop improved equipment that is adapted to this development without risk of interruption during operation.

The problem addressed by the invention is to dissolve more polymer in a shorter time, in a smaller space, while taking into consideration the weight constraints, all without manual feeding operation during operation.

One of the constraints lies in the fact that there is no device, at the site of operations, which makes it possible to empty the polymer solutions from the dissolution tanks. Consequently, the equipment must be moved with the tanks full, it being possible however for the amount of powder to be adjusted at the end of operation. This also has the advantage of allowing an immediate start-up of the equipment after travelling.

The Applicant has developed improved equipment that makes it possible to solve this problem and to significantly improve the performances of existing installations.

The invention relates to improved compact and transportable equipment that can be used for fracturing operations on gas or oil fields, said equipment being characterized in that it comprises successively:

- a pneumatic means for supplying a silo with powder polymer,
- a silo for storing polymer in powder form,
- a means for conveying the polymer from the silo into a feed hopper,
- a feed hopper of a polymer metering device, said hopper being endowed with a top level and a bottom level,
- a device for metering out the powder polymer,
- a device for dispersing and grinding the polymer, also referred to as a PSU (polymer slicing unit) comprising:
  - a cone for wetting the powder polymer connected to a primary water inlet circuit,
  - at the lower end of the cone:

a dispersed polymer grinding and drainage chamber comprising:

a motor-driven rotor equipped with blades, a fixed stator constituted of a cylinder equipped with thin slots, over all or part of the periphery of the chamber, a ring supplied by a secondary water circuit, the ring communicating with the chamber so as to ensure the spraying of pressurized water over the outside of the stator thus enabling the release of the ground and swollen polymer at the surface of said stator, at least two tanks for hydrating and dissolving the dispersed polymer originating from the dispersing and grinding device, at least two volumetric pumps enabling the injection and metering of the polymer solution obtained in the mixer used for supplying the high-pressure fracturing pump.

In one preferred embodiment, the equipment is positioned in a container or on a trailer and has a weight of less than 24 tonnes, preferably less than 22 tonnes, taking into account the amounts of polymer solutions contained in the tanks, and the amount of powder contained in the silo, allowing an immediate start-up. Furthermore, the equipment will not exceed a length of 14 meters, preferably 12 meters.

In one preferred embodiment, the storage silo is horizontal, of parallelepipedal shape and is equipped with a dihedron-shaped base.

The storage silo has a volume advantageously greater than or equal to 5 $m^3$, and preferably greater than or equal to 10 $m^3$.

The pneumatic means for supplying the silo is in the form either of a road tanker equipped with cones for discharging the polymer, or of a lorry with a tipping chassis.

The means for conveying the polymer into the feed hopper of the dissolution device is constituted of a lower discharge screw positioned at the base of the silo, said screw being connected either to a vertical screw for feeding the hopper, or to a pneumatic conveyor connecting the bottom of the silo to the feed hopper.

The dispersing and grinding device allows a hydraulic grinding of the polymer. It has the great advantage of dispersing very large amounts of polymers while greatly decreasing the size of the equipment and accelerating the dissolution of the polymer by wet grinding. This enables very large injections of polymer from equipment of limited volume.

The volumetric pumps positioned between the dissolution tanks and the injection pump will for example be chosen, without this being limiting, from lobe pumps, such as for example pumps of Waukesha type, and particularly lobe 6 pumps giving a flow rate of 30 $m^3$/h at 3 bar, or else eccentric rotor pumps of Myono type that can give the same flow rate.

The components of the equipment according to the invention are arranged in a smaller space, such as a container or a lorry trailer.

The selection of the various components depends in particular on the available volume, on the maximum empty weight, on the total amount of the polymer solution to be injected and on its flow rate.

A dispersing and grinding device similar to that used in the invention was described by the Applicant in document WO 2008/107492 for enhanced oil recovery (EOR) applications. This dissolution device, referred to as PSU (polymer slicing unit), is advantageously that sold under the name PSU 300 Plus, which makes it possible to meter out 100 to 600 kg of polymer per hour. These amounts are in accordance with those needed in current fracturing operations. The diameter of the rotor-stator of the polymer dissolution device is preferably greater than 200 mm. In the majority of cases, the PSU operates intermittently, depending on the level of the dissolution tanks at a standard flow rate of 300 kg/hour. It is, however, suitable for much higher spot demands of polymer. The water is fed, into the PSU, at the primary circuit generally at 10 $m^3$/h and at the secondary circuit from 0 to 20 $m^3$/h depending on the required concentration and viscosity. The polymer concentration is preferably 20 g/liter. On the other hand, when concentrated brines are used, the effect of the salts on the viscosity makes it possible to increase the concentration to 30 g/liter while keeping the viscosity of the polymer solution below 10 000 cps, enabling easy pumping.

The dissolution tanks have a limited volume on account of the dimensions of the equipment. Generally, the equipment may comprise two tanks of 4 to 5 $m^3$. These tanks are generally vigorously stirred in order to promote the dissolution of the polymer. Moreover, these two tanks may work in series, continuously, in parallel, or by transfer from one to the other (flip-flop). The volumetric pumps may operate together or separately in order to supply the mixer that is used for supplying the high-pressure fracturing pump.

As the fracturing operations involve water flow rates of the order of 20 to 30 $m^3$/hour, the dissolution time should generally be less than 30 minutes.

One solution consists in adapting the dissolution rate to the given time. Commercially available acrylamide-based polymers generally have a particle size from 0 to 1000 microns and a dissolution time of the order of one hour for polymers of average anionicity (20 to 50 mol %) and two hours for nonionic polymers. Consequently, the particle size of the powder should be adjusted as a function of the desired dissolution time. Empirically, the following dissolution times were determined:

| Anionic polymer | | Nonionic polymer | |
|---|---|---|---|
| 0-1000 microns | 60 min | 0-1000 microns | 120 min |
| 0-800 microns | 40 min | 0-800 microns | 70 min |
| 0-600 microns | 20 min | 0-600 microns | 40 min |
| 0-400 microns | 10 min | 0-400 microns | 20 min |
| | | 0-300 microns | 10 min |

Passage through the PSU makes it possible to decrease the dissolution time by 20 to 30% on the largest particle sizes and by slightly less on the smaller particle sizes.

It is possible industrially to grind these polymers to these particle sizes with an additional cost. However, the content of fines (<50 μm), which saturate the filters and are highly hygroscopic, should be limited.

Still according to the invention, the protection control, instrumentation and safety electrical equipment is arranged in an electrical room and is controlled by a programmable controller that allows total automation of the equipment with control via the main control room of the whole of the fracturing operation.

Another subject of the invention is a process for the hydraulic fracturing of gas or oil wells by injection of a fluid comprising a polymer solution using the installation described previously.

The implementation of the equipment according to the invention in the process according to the invention makes it possible to reduce the fracturing injection pressure while limiting the friction of the fluid in the injection pipes.

In one advantageous embodiment, the process according to the invention is characterized in that the polymers in powder form that are used have a particle size from 0 to 500 μm, preferably from 0 to 400 μm irrespective of the ionicity of the polymers, and preferably from 0 to 300 μm for nonionic polymers.

According to one advantageous embodiment, the process according to the invention is characterized in that the total residence time of the polymer in the hydration tanks is between 20 and 30 minutes.

Various types of synthetic or natural polymers will be able to be dissolved owing to the equipment according to the invention. Mention will be made, non-limitingly, of the acrylamide-based polymers and guar gums commonly used in fracturing processes.

During the dispersion of polymers in the PSU, the other chemical compounds of the fracturing fluid could be added in the PSU.

If these chemicals ingredients are in powder form, they could be pre-mixed in powder form with the polymers, the said mixture being then added in the PSU, or they could be added simultaneously with the polymers into the PSU.

If these chemicals ingredients are in liquid form, they could be added into the PSU with a pump, for example into the primary or the secondary water inlet circuit, or separately from the two inlets.

Chemicals compounds used in fracturing are chosen in the non-limitative following list:

borate crosslinker, clay stabilizer, surfactants, pH buffer, Guar hydration aid, ammonium persulfate, scale inhibitor, choline chloride, bacteriacide, enzyme breaker, temperature stabilizer, friction reducer (cationic polyacrylamide), basis, acids, iron reducer, corrosion inhibitor.

The invention and the advantages that result therefrom will become more clearly apparent from the following exemplary embodiment in support of the appended figures.

DETAILED DESCRIPTION OF THE INVENTION

Figure 1:
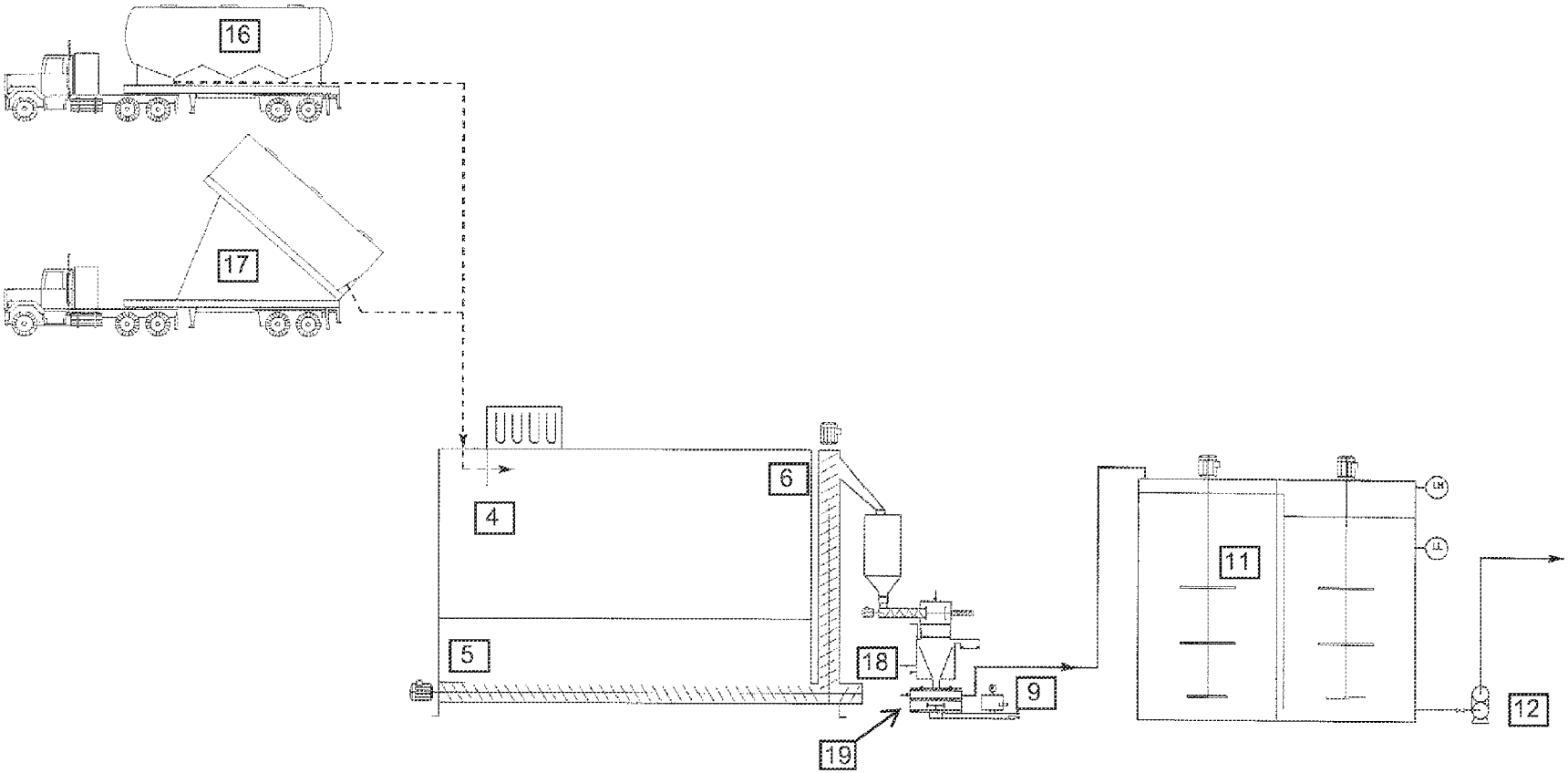
FIG. 1 is a schematic lateral view of flows in the equipment according to one advantageous embodiment of the invention.
Figure 2:
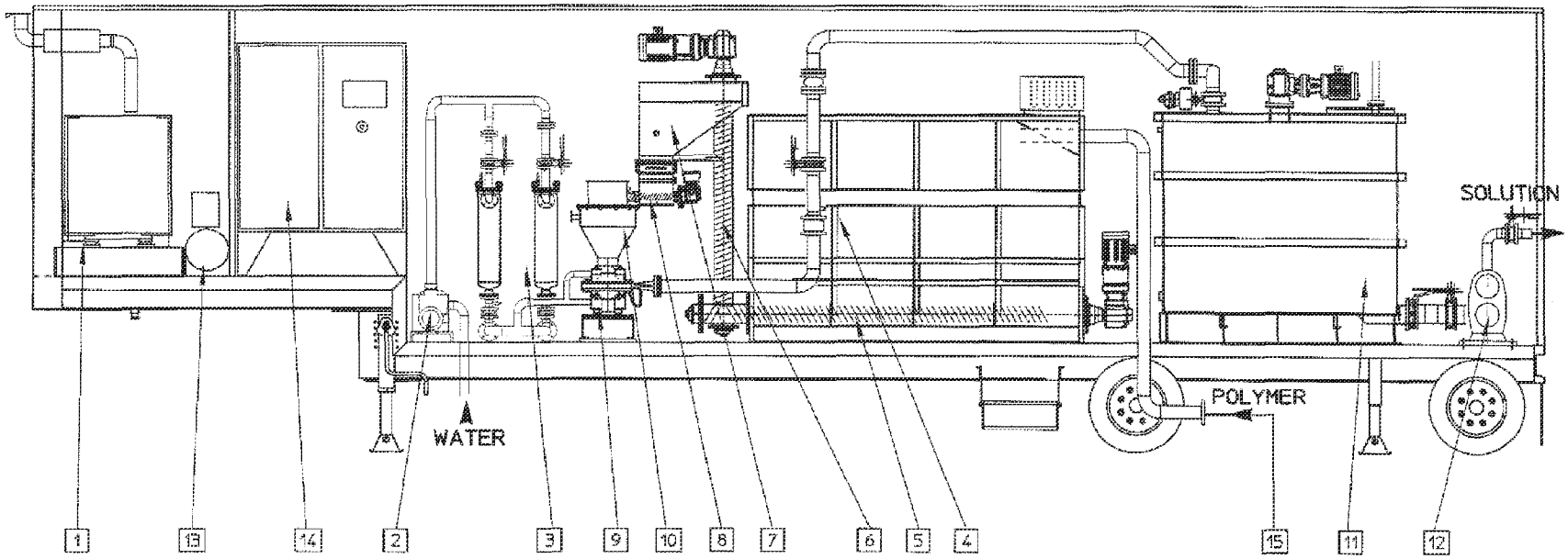
FIG. 2 is another schematic lateral view of the equipment according to one advantageous embodiment of the invention.

As already stated, the space available for the equipment that is the subject of the invention is generally limited, it is therefore impossible to install a cylindro-conical silo. The storage silo (4) illustrated by FIG. 2 is horizontal, of parallelepipedal shape and has a base in the shape of a dihedron. Located in this dihedron is a discharge screw (5) which feeds a lifting screw (6) for feeding the PSU with powder polymer by gravity. The lifting screw may optionally be replaced by a pneumatic conveyor.

This silo is fed pneumatically by a road tanker that transports the polymer, with emptying via cones (16) or a tipping chassis (17). The feeding of the silo with powder polymer may take place before or during operation, depending on the volumes required. But the apparatus transports enough polymer in powder form (2 to 3 tonnes for example) for an immediate start-up.

The storage silo has a volume greater than or equal to 5 $m^3$, preferably greater than or equal to 10 $m^3$.

FIG. 2 represents a trailer that enables the supply of a large fracturing operation.

The equipment from this example makes it possible to ensure, on average, 10 successive injections of a polymer solution for an amount of more than 12 tonnes of polymer, with a maximum polymer powder flow rate of 300 kg/hour.

The limitation of the size of the equipment for the operating conditions in the USA is w=2.4 m, H=3 m not including the chassis, L=13.4 m.

The maximum weight not including the chassis during transfer is 22 tonnes maximum. During transfer means that at the end of a fracturing operation, the tanks being full and it being possible for the silo to contain 2 to 3 tonnes of polymer, the trailer should move with full tanks, without possible emptying.

This assembly is composed of (FIG. 2):

An electrical generator (1) allowing an autonomous power supply of the onboard equipment, of 150 kW with a fuel tank allowing full operation.

A water pump (2) making it possible to avoid the very large pressure variations of the feed lines during operations. The flow rate is 30 $m^3$/h at a pressure of 3 bar and an NPSH of 3 meters.

A duplex filter (3) with 200 micron pockets to remove the matter in suspension in the water that might block or erode the PSU.

A horizontal silo of 10 $m^3$ (4) of parallelepipedal shape with a dihedral base in which is located a 200 mm screw (5) for conveying the powder to the outlet tube. This screw is protected by a torque limiter.

A vertical screw (6) 120 mm in diameter for raising the powder at a flow rate of 600 kg/hour above the PSU hopper. This vertical screw may be replaced by a pneumatic conveyor.

A conical hopper (7) (PSU feed) and top and bottom detectors for starting or stopping the above two screws. At the bottom of this hopper is a metering screw (8) for metering out 100 to 500 kg of powder per hour by speed variation. Usually the flow rate will be fixed and will be 300 kg/h.

A PSU (9) that is improved by increasing the rotor-stator diameter to 210 mm. This PSU is fed at the upper portion with 10 $m^3$/h of powder polymer and at the lower portion with from 0 to 20 $m^3$/h of water. The water and powder flow rates may be adjusted as a function of the desired conditions.

The water and powder are mixed in a wetting cone (10) that may be Teflon-coated to prevent the powder from sticking to the cone in the event of poor levelling on the unprepared lands used. Indeed, the fracturing operations often take place on cursorily levelled agricultural lands.

The suspension thus obtained is sent into two vigorously stirred 4.5 $m^3$ tanks in series (11). The second tank being equipped with a top and bottom level measure allowing start-up or stoppage of the PSU.

At the outlet of these tanks, the solution is metered out by two variable-speed volumetric pumps in parallel.

These two pumps may advantageously be Waukesha lobe pumps (12) model 60, flow rate 30 $m^3$/h. The flow rate may be modified from the main control room as a function of the observed injection pressures. Two pumps are installed as a safety measure, but may be used together in the event of a very high spot demand (incident). In this case, the storage tanks serve as buffer.

Utilities are furthermore installed in this equipment with a 1 kW air compressor (13) used for the pneumatic declogging of the dust filter and for the opening and closing of pneumatic valves automatically.

All the control, protection, instrumentation and safety electrical equipment is located in an electrical room (14) and is controlled by a programmable controller that allows total automation of the equipment with control via the main control room of the whole of the fracturing operation.

A tipping bulk road tanker (17) supplies the silo with powder polymer (15) at the start of the operation or during the operation by pressurized pneumatic conveying.

The particle size of the powder is adapted to the usual dissolution time of 20 to 30 minutes. For anionic polymers at 30% anionicity the chosen particle size will be from 0 to 500 microns.

During these operations, this equipment has made it possible to achieve performance levels that had never been reached until then. The results obtained are excellent because the equipment henceforth makes it possible to dissolve a large amount of polymer (greater than 12 t) at a high flow rate while being in accordance with the space and weight constraints.

Industrially, it is found that there are fewer users of powder polymer for fracturing than those who conventionally use emulsions. Nevertheless, since the cost of the powder is lower than that of the emulsion, a significant economic advantage is observed, even taking the depreciation of the equipment into account.

A person skilled in the art will be able to substitute similar equipment as a function of the requirements, while respecting the volumes, weights and final feed of the gas or oil recovery operation.

What is claimed is:

1. Compact and transportable equipment adapted to be used for fracturing operations on gas or oil fields, said equipment comprising, successively:

a pneumatic means for supplying a silo with powder polymer, a silo for storing polymer in powder form, a means for conveying the polymer from the silo into a feed hopper, a feed hopper of a polymer metering device, said hopper being endowed with a top level and a bottom level, a device for metering out the powder polymer, a device for dispersing and grinding the polymer, said device comprising:

a cone for wetting the powder polymer connected to a primary water inlet circuit, at the lower end of the cone:

a dispersed polymer grinding and drainage chamber comprising:

a motor-driven rotor equipped with blades, a fixed stator constituted of a cylinder equipped with thin slots, over all or part of the periphery of the chamber, a ring supplied by a secondary water circuit, the ring communicating with the chamber so as to ensure spraying of pressurized water over an outside of the stator, thus enabling release of ground and swollen polymer at a surface of said stator, at least two tanks for hydrating and dissolving the dispersed polymer originating from the dispersing and grinding device, at least two volumetric pumps enabling injection and metering of the polymer solution obtained in a mixer used for supplying a high-pressure fracturing pump.

2. The equipment according to claim 1, wherein the equipment is positioned in a container or on a trailer and has a weight of less than 24 tonnes, taking into account amounts of polymer solutions contained in the tanks, and an amount of powder contained in the silo.

3. The equipment according to claim 2, wherein the equipment is positioned in a container or on a trailer and has a weight of less than 22 tonnes, taking into account amounts of polymer solutions contained in the tanks, and an amount of powder contained in the silo.

4. The equipment according to claim 1, wherein the storage silo is horizontal, of parallelepipedal shape and is equipped with a dihedron-shaped base.

5. The equipment according to claim 1, wherein the storage silo has a volume greater than or equal to 5 $m^3$.

6. The equipment according to claim 5, wherein the storage silo has a volume greater than or equal to 10 $m^3$.

7. The equipment according to claim 1, wherein the pneumatic means for supplying the silo is in the form either of a road tanker equipped with cones for discharging the polymer, or of a lorry with a tipping chassis.

8. The equipment according to claim 1, wherein the means for conveying the polymer into the feed hopper of the dissolution device is constituted of a lower discharge screw positioned at a base of the silo, said screw being connected either to a vertical screw for feeding the hopper, or to a pneumatic conveyor connecting a bottom of the silo to the feed hopper.

9. The equipment according to claim 1, wherein the dissolution tanks each have a volume between 4 and 5 $m^3$.

10. The equipment according to claim 1, wherein the volumetric pumps are lobe pumps or eccentric rotor pumps giving a flow rate of 30 $m^3/h$ at 3 bar.

11. The equipment according to claim 1, further comprising protection control, instrumentation and safety electrical equipment arranged in an electrical room, said protection control, instrumentation and safety electrical equipment controlled by a programmable controller that allows total automation of the equipment with control via a main control room of the whole of the fracturing operation.

12. The equipment according to claim 1 wherein said device for dispersing and grinding the polymer comprises a polymer slicing unit (PSU).

* * * * *